United States Patent [19]

Mutchler

[11] Patent Number: 4,753,593

[45] Date of Patent: Jun. 28, 1988

[54] FUEL BURNER ASSEMBLY

[75] Inventor: Paul A. Mutchler, St. Louis County, Mo.

[73] Assignee: Engineered Air Systems, Inc., St. Louis, Mo.

[21] Appl. No.: 98,963

[22] Filed: Sep. 21, 1987

[51] Int. Cl.[4] ..... F23Q 3/00

[52] U.S. Cl. ..... 431/265; 431/183

[58] Field of Search ..... 431/265, 183, 352

[56] References Cited

U.S. PATENT DOCUMENTS 2,665,748 1/1954 Cornelius ..... 431/265

FOREIGN PATENT DOCUMENTS 1288723 9/1972 United Kingdom ..... 431/183

*Primary Examiner*—Carroll B. Dority, Jr.

*Attorney, Agent, or Firm*—Ralph B. Brick

[57] ABSTRACT

A fuel burner assembly for providing a stable, non-pulsating flame wall proximate to a burner duct outlet thereof including structure which causes a combustion air stream to flow radially outwardly and then inwardly across a fuel supply outlet and spaced igniter centrally positioned adjacent the duct outlet, the stream then being divided into three flow paths, one path being axial, another being centrally rotated and a third being annularly compacted to stabilize the produced flame wall proximate the duct outlet.

12 Claims, 4 Drawing Sheets

FUEL BURNER ASSEMBLY

BACKGROUND OF THE INVENTION

The present invention relates to space heating apparatus and more particularly to an improved fuel burner assembly which provides a stable, non-pulsating flame wall proximate the outlet of a burner duct.

Various burner devices have been employed in the past which include a burner duct into which fuel and air are injected and burned and from which the heated combustion products are introduced into a heated combustion chamber and subsequently to a heat exchanger. A number of arrangements have been employed to divert the air in a preselected pattern to be mixed with a fuel for burning, attention being directed to several such arrangements as disclosed in the long since expired U.S. Pat. No. 1,512,132, issued to F. G. Pfahl on Oct. 21, 1924, and the more recently expired or soon to expire U.S. Pat. No. 3,109,481, issued to R. L. Yahnke on Nov. 5, 1963; U.S. Pat. No. 3,223,136, issued to P. A. Mutchler on Dec. 14, 1965; and U.S. Pat. No. 3,593,969, issued to H. R. Smithson et al on July 20, 1971. These abovementioned patents all have been concerned to various extents in establishing efficient stable flame production, but none has recognized or resolved those problems which have been recognized and solved by the unique and novel fuel burner apparatus described herein.

In accordance with the present invention, a novel burner assembly is provided which recognizes that forced draft heating systems, as distinguished from natural draft or balanced draft heating systems, require burner pressures sufficient to overcome the resistances offered by the combustors and heat exchangers with which they are coupled, particularly those combustor-heat exchanger arrangements wherein the flame delivered by the burner follows a first direction and is then reversed in direction to the flue gas outlet. In addition, the present invention recognizes the desirability of a burner arrangement which can establish a stable non-pulsating flame wall or front—that is the location of a plane normal to the longitudinal axis of a burner where the flame steadily burns. The present invention further recognizes that it is desirable that such a flame wall be not only stable but continuous over a broad range of temperatures and that it be operative in various environmental or ambient extremes to which a selected burner and associated equipment might be subject.

Recognizing these burner problems, the present invention provides a burner assembly which can be economically and efficiently manufactured and assembled with a minimum of parts and a minimum of maintenance, the inventive burner assembly producing a comparatively quiet, non-pulsating flame. Further, the fuel burner assembly of the present invention is capable of starting and operating for long periods of time over comparatively wide ranges of firing rates and varying ambient conditions with relatively high thermal efficiency and low contaminant production.

Various other features of the present invention will become obvious to one skilled in the art upon reading the disclosures set forth herein.

BRIEF SUMMARY OF THE INVENTION

More particularly, the present invention teaches a fuel burner assembly capable of providing a stable, non-pulsating flame wall proximate the outlet of a burner duct comprising: a burner duct having an upstream inlet end and a downstrem outlet end, the inlet end being adapted to be connected to a source of combustion air and the outlet end being adapted to accommodate a burner flame wall proximate thereto; a sleeve member supportively disposed within the burner duct to extend along the longitudinal axis thereof, the sleeve member having inlet and outlet ends with the inlet end of the sleeve member communicating with the inlet end of the burner duct to receive combustion air therefrom and the outlet end communicating with the outlet end of the burner duct and with the outer wall of the sleeve member and the inner wall of the burner duct defining an air flow diversion chamber of preselected volume therebetween; a transverse baffle member extending across the inner wall of the sleeve member intermediate the inlet and outlet ends thereof to define upstream and downstream chambers within the sleeve member between the inlet and outlet ends thereof; first air passage means in the sleeve member wall between the upstream chamber and the diversion chamber and second air passage means in the sleeve member wall between the diversion chamber and the downstream chamber whereby a sufficient volume of combusion air to support continuous combustion flows radially outward from the upstream chamber axially through the diversion chamber and radially inward into the downstream chamber; and spaced fuel outlet and igniter means selectively positioned in the downstream chamber proximate the outlet end thereof to ignite with radially inward directed combustion air to create a burner flame wall proximate the outlet end of the burner duct. In addition, the present invention teaches a unique flamelock plate arrangement downstream of the area of flame ignition which provides for a number of cooperating passages therethrough and therearound to enhance flame wall stability.

It is to be understood that various changes can be made by one skilled in the art in one or more of the several parts of the apparatus disclosed herein without departing from the scope or spirit of the present invention.

BRIEF DESCRIPTION OF THE DRAWINGS

Referring to the drawings which disclose one advantageous embodiment of the present invention.

DETAILED DESCRIPTION OF THE PREFERRED EMBODIMENT

Figure 1:
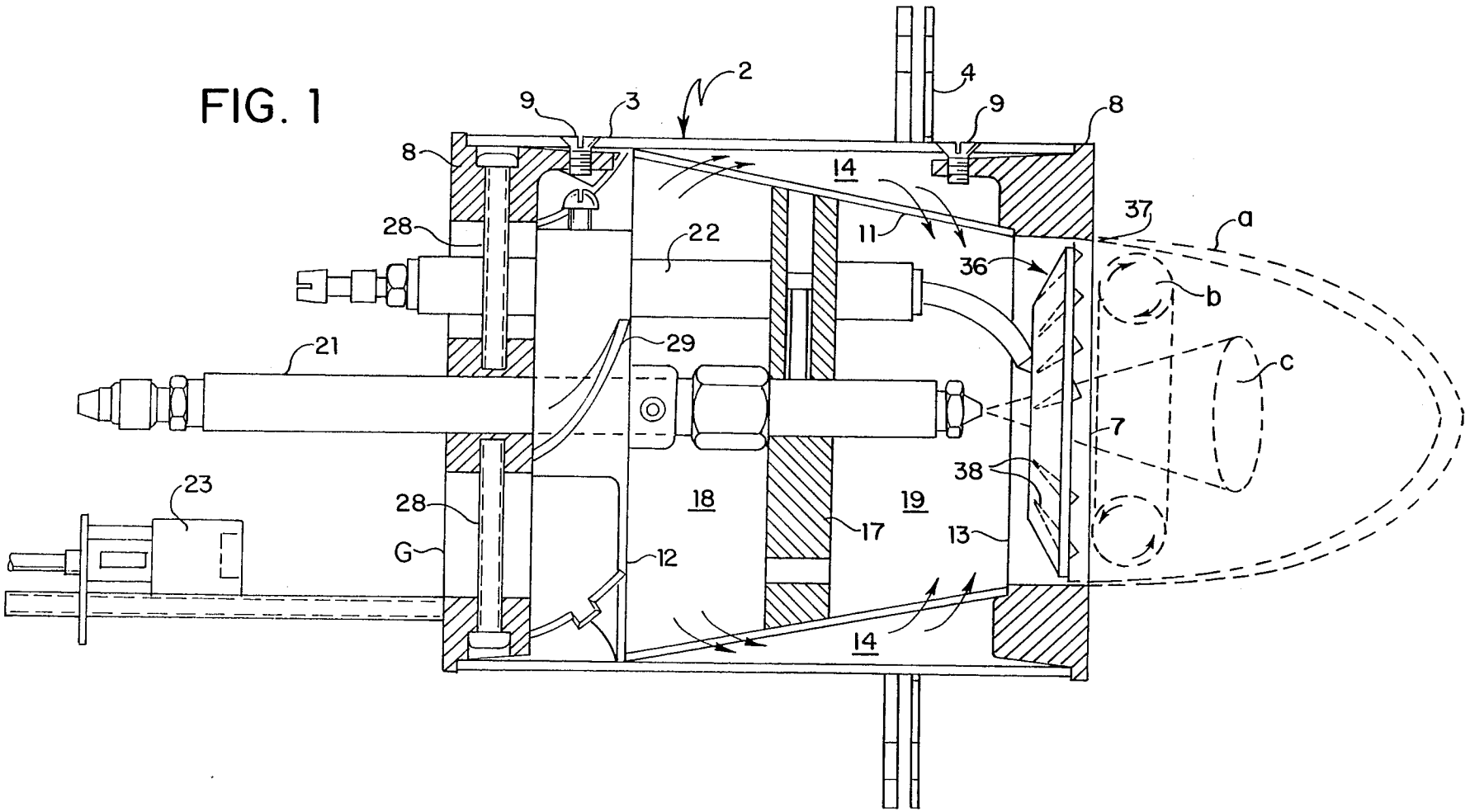
FIG. 1 is a cross-sectional view of the overall fuel burner assembly of the present invention.
Figure 4:
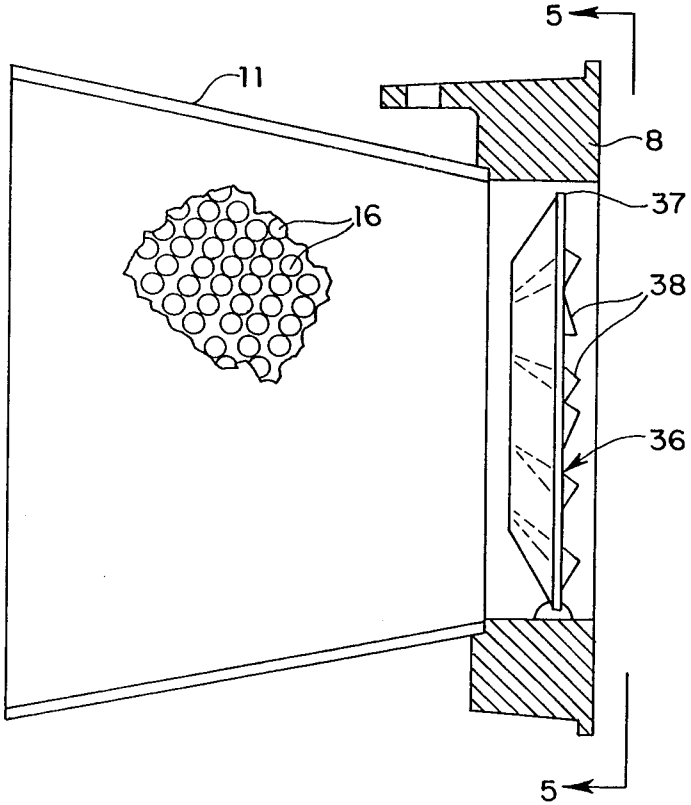
FIG. 4 is a partially broken away side view of another portion of the assembly of FIG. 1, this structure being efficiently assembled with the structure of FIG. 2.
Figure 7:
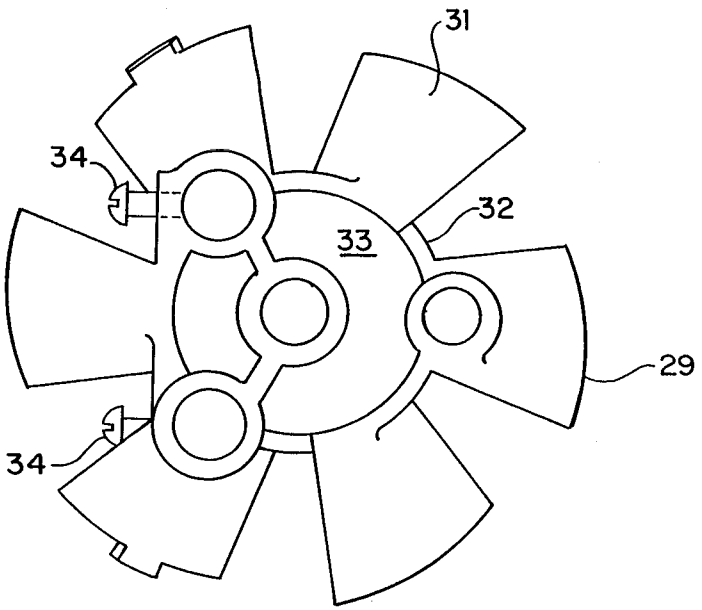
FIG. 7 is an end view of the stabilizer of FIG. 6 taken in a plane through line 7—7 of FIG. 6.
Figure 6:
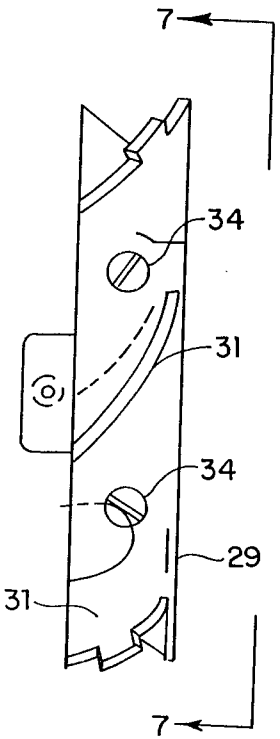
FIG. 6 is a somewhat side reduced view of another part of the assembly of FIG. 1—namely, the inlet stabilizer.

Referring to FIG. 1 of the drawings, the overall inventive fuel burner assembly for provding a stable, non-pulsating flame wall proximate the outlet of the burner duct thereof is broadly referred to by reference numeral 2. The burner 2 includes a longitudinally extending cylindrical burner duct 3 surrounded by a suitable apertured gasket 4 for appropriate mounting to a cobmustion chamber (not shown) with which the burner is to be associated. In this regard, it is to be noted that the novel burner described herein is particularly useful for association with combustion chambers offering comparatively high resistance to the burner flame such as those combustion chambers wherein the ignited gasses flow along the central axis of the combustion chambers in a first direction away from the burner flame wall and then flow in a reverse direction to a fuel gas exhaust duct more proximate to the flame wall of the burner. The burner duct 3 can be made of a suitable metallic material to resist the high temperatures and wide temperature gradients to which the burner is subjected during heating operations. Duct 3 includes an upstream inlet end 6 and a downstream outlet end 7. Fastened to the inner wall of duct 3 at the upstream inlet end 6 and downstream outlet end 7 is a pair of spaced, peripheral annular support fire rings 8. Rings 8 can be fastened to the inner wall of duct 3 by any one of a number of suitable means, the rings being fastened to duct 3 in longitudinal alignment by suitable screws 9 passing through apertures in the duct 3. A truncated cone 11 (FIGS. 1 and 4) having cone inlet end 12 and cone outlet end 13 is disposed in burner duct 3. The cone inlet end 12 forms the base of truncated cone 11 and fits snugly against the inner wall of burner duct 3 intermediate its spaced inlet and outlet ends 6 and 7 to receive combustion air therefrom, the inlet end 6 of duct 3 being appropriately adapted to be connected to a suitable source of combustion air such as a blower (not shown). The smaller cone outlet end 13 nests against and is fastened to downstream support ring of ring pair 8 by some suitable means such as brazing, or welding or by mechanical fasteners to communicate with the downstream outlet end 7 of duct 3. The outer wall of truncated cone 11, which also can be made of suitable metallic material to withstand the high temperatures and wide gradients aforedescribed, forms an air flow diversion chamber or plenum 14 with the inner wall of burner duct 3. Depending upon the length and slope of truncated cone 11, diversion chamber or plenum 14 can be of a preselected volume with the chamber increasing in cross-section along the line of flow upstream to downstream end to vary the velocity and pressure of dampened air flowing therealong. As can be seen in FIG. 4 and as disclosed by the flow arrows of FIG. 1, truncated cone 11 is provided with a plurality of spaced apertures 16 through the surrounding wall thereof. These spaced apertures 16 extend advantageously from the upstream cone inlet end 12 to the downstream cone outlet end 13 to advantageously define an approximately twenty-nine (29) percent total open area through the side or surrounding wall of truncated cone 11 to form a first series of air outlet passages and a second series of air inlet passages in communication with diversion chamber or plenum 14. In this reagrd, it is to be noted that truncated cone 11 is provided with a suitable transverse baffle member 17 extending across the inner wall of cone 11 intermediate upstream inlet end 12 and downstream outlet end 13 to define an upstream cone chamber 18 in communication with the first series of air outlet passages and a downstream cone chamber 19 in communication with the aforedescribed second series of air inlet passages. Accordingly, during burning operations, a sufficient amount of combustion air to support the desired continous combustion flows in dampened fashion radially outward from upstream cone inlet chamber 18 to diversion chamber 14 and then radially inward from chamber 14 to downstream cone outlet chamber 19.

Figure 3:
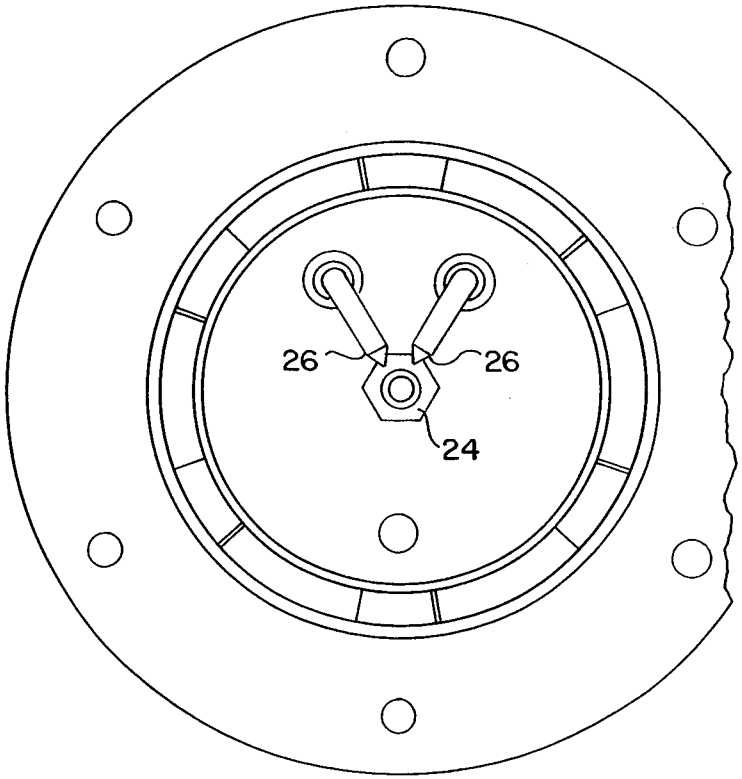
FIG. 3 is an end view of the structure of FIG. 2 taken in a plane through line 3—3 of FIG. 2.
Figure 2:
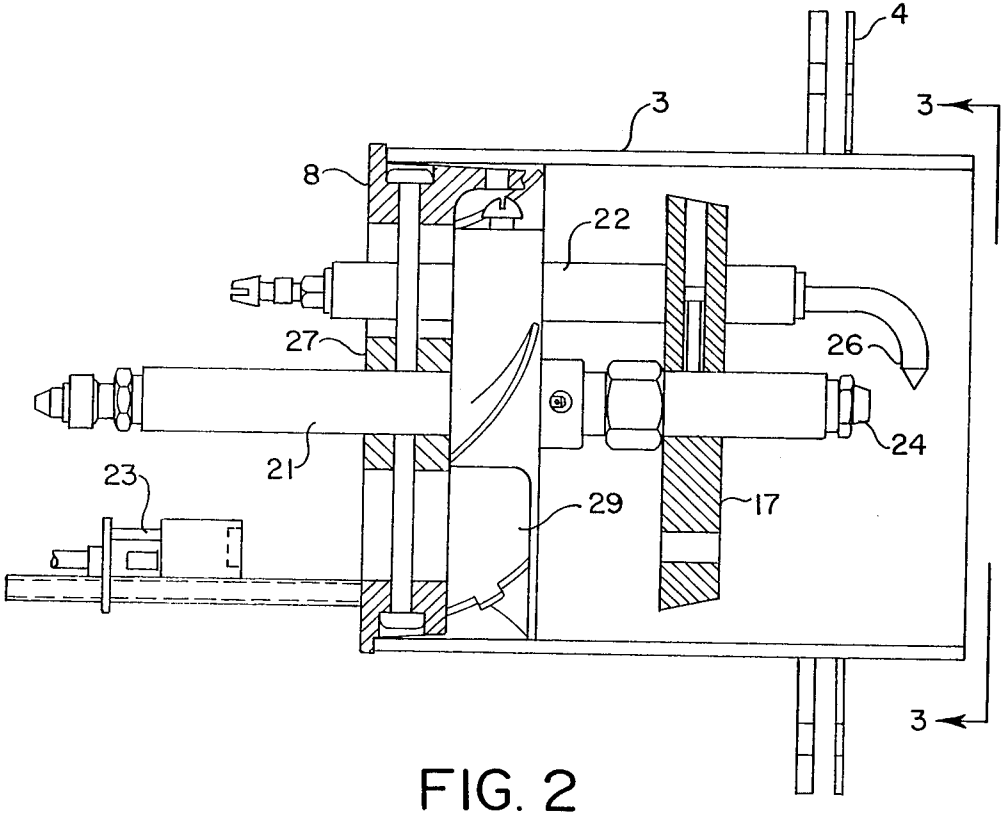
FIG. 2 is a cross-sectional view of a portion of the assembly of FIG. 1, serving to disclose the efficient manner in which the inventive burner arrangement can be constructed for burner assembly.

It is to be noted in FIGS. 1–3 of the drawings that transverse baffle 17 is provided with a plurality of spaced apertures therein to allow a fuel supply tube 21 and a pair of igniter electrodes 22 to pass snugly therethrough in supported relationship therewith. Baffle 17 further includes an aperture for a line of sight photoelectric flame detector 23 suitably supported adjacent the inlet end 6 of burner duct 3 to monitor flame conditions. Fuel supply tube 21 and spaced igniter electrodes 22 terminate in the downstream chamber 19 of truncated cone 11 in a spaced fuel outlet 24 and spaced igniter tips 26, respectively. The fuel outlet 24 and igniter tips 26 are centrally positioned in downstream chamber 19 so as to be proximate cone outlet end 13 to ignite with the inwardly directed dampened combustion air radially introduced into downstream cone chamber 19 from diversion chamber 14. It further is to be noted in FIGS. 1–3 of the drawing that an adjustable support arrangement to adjust the alignment of fuel supply tube 21 as well as to support the same is provided between upstream support ring 8 and fuel supply tube 21. This adjustable support arrangement includes a collar member 27 surrounding fuel supply tube 21, the collar 27 being internally threaded to receive the threaded ends of radially disposed, spaced adjusting screws 28 which pass through suitable apertures in upstream support ring 8.

As can be seen in FIGS. 1, 2, 6 and 7, positioned adjacent to upstream support ring 8 in downstream relation thereto is a suitable air flow stabilizer 29. Air flow stabilizer 29 includes a plurality of curved, spaced air twirler vanes 31 extending from annular ring 32, the ring 32 permitting passage of combustion air in twirled fashion by blades 31 and further permitting air passage through the central passages 33. Stabilizer 29 is designed to include suitably spaced apertures therein to permit snug passage of fuel supply tube 21 and igniter electrodes 22 therethrough and to permit line of sight operation of flame detector 23. As disclosed, set screws 34 cooperating with two of the spaced apertures, permit fast engagement with the said walls of igniter electrodes 22.

Figure 5:
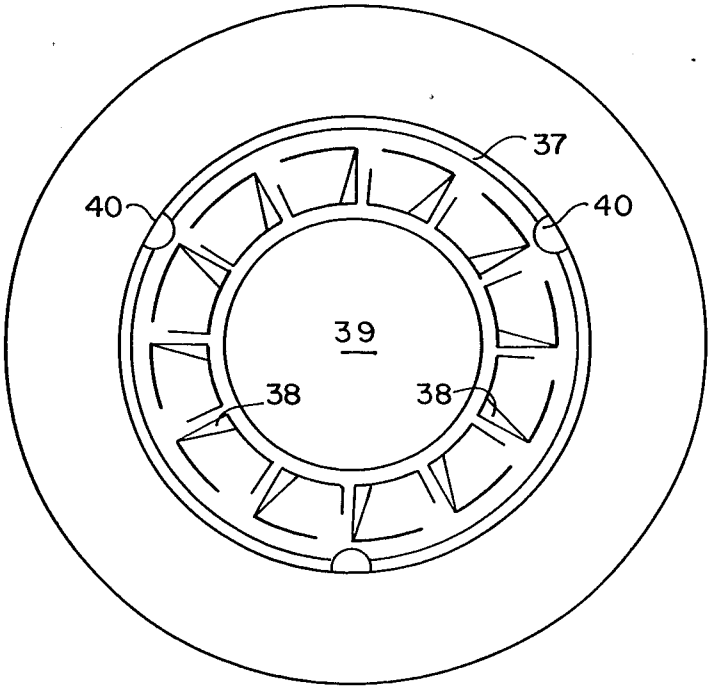
FIG. 5 is an end view of the structure of FIG. 4 taken in a plane through line 5—5 of FIG. 4.

Referring to FIGS. 1, 4 and 5 of the drawings, a slotted disc-like annular flamelock plate member 36 can be seen as adjustably mounted by slotted screws 40 in spaced relation with outlet peripheral downstream support ring 8 to define therebetween a first compacting annular flow passage 37 (FIG. 4), the ignited mixture passing therethrough being indicated in FIG. 1 of the drawings by the phantom line parabola designated by the letter "a". A second flow passage is created by right angle slots 38 radially spaced around plate member 38, where secondary combustion air passing through slots 38 is indicated by the rotating small arrows within the phantom line torus designated by the letter "b". Finally, a third flow passage is created by central opening 39, the cone-like flow therethrough consisting of atomized fuel and primary combustion air and being indicated by the phantom line cone designated by the letter "c". During fuel burning operations with the resulting dampening of air flow through the radially outward and then radially inward passages followed by the subsequent ignited mixture flowing through central passage 39, right angle slots 38 and peripheral opening 37 between the outer diameter of plate member 36 and the inner diameter of downstream support ring 8, an enhanced burner flame wall is created proximate burner duct outlet end 7 which is both stable and non-pulsating, the arrangement permitting this being both efficient and economical to manufacture and assemble.

The invention claimed is:

1. A fuel burner assembly for providing a stable, non-pulsating flame wall proximate the outlet of a burner duct comprising:

a burner duct having an upstream inlet end and a downstream outlet end, said inlet end being adapted to be connected to a source of combustion air and said outlet end being adapted to accommodate a burner flame wall proximate thereto;

a sleeve member supportively disposed within said burner duct to extend along the longitudinal axis thereof, said sleeve member having inlet and outlet ends with said inlet end of said sleeve member being adapted to communicate with said inlet end of said burner duct to receive combustion air therefrom and said outlet end of said sleeve member being adapted to communicate with the outlet end of said burner duct with the outer wall of said sleeve member and the inner wall of said burner duct in which said sleeve member is disposed defining an air flow diversion chamber of preselected volume therebetween;

a transverse baffle member extending across the inner wall of said sleeve member intermediate the inlet and outlet ends thereof to define upstream and downstream chambers within said sleeve member between said inlet and outlet ends thereof;

first air passage means in said sleeve member wall between said upstream chamber and said diversion chamber and second air passage means in said sleeve member wall between said diversion chamber and said downstream chamber whereby a sufficient volume of combustion air to support continuous combustion flows radially outward from said upstream chamber axially through said diversion chamber and radially inward into said downstream chamber; and spaced fuel outlet and igniter means selectively positioned in said downstream chamber proximate the outlet end thereof to ignite with said radially inward directed combustion air to create a burner flame wall proximate the outlet end of said burner duct.

2. The fuel burner assembly of claim 1, said air flow diversion chamber increasing in cross-section from the upstream end toward the downstream end to vary the velocity and pressure of the air flowing therealong accordingly.

3. The fuel burner assembly of claim 1, said sleeve member being in the geometric form of a truncated cone with the base thereof defining said inlet of said sleeve member, said inlet end being scaled to said inner wall of said burner duct.

4. The fuel burner assembly of claim 1, said first and second air passage means comprising a plurality of spaced apertures through said sleeve wall to define a preselected open area through said side wall.

5. The fuel burner assembly of claim 1, said first and second air passage means comprising a plurality of spaced apertures through said sleeve wall to define an approximately twenty-nine (29) percent total open area through said side wall.

6. The fuel burner assembly of claim 1, said transverse baffle in said sleeve member having a plurality of spaced apertures therein; and a fuel supply tube and at least one igniter electrode passing snugly therethrough to be supported by said baffle and connected with said spaced fuel outlet and igniter means centrally positioned in said downstream chamber.

7. The fuel burner assembly of claim 1, and peripheral support means fastened to the inner wall of said burner duct and the outer wall of said sleeve to support said sleeve in spaced relation to said duct defining said air flow diversion chamber between said duct and said sleeve.

8. The fuel burner assembly of claim 1, and a slotted annular flamelock plate member positioned adjacent to said sleeve member outlet end in preselected position relative said spaced fuel outlet and igniter means to provide a first annular passage therearound, a second rotating passage therethrough and a third axial flow passage through the central opening thereof to enhance said burner flame wall and its location approximate the outlet end of said burner duct.

9. The fuel burner assembly of claim 1, including peripheral support means fastened to the inner wall of said burner duct and the outer wall of said sleeve adjacent said outlet ends thereof to support said sleeve in spaced relation to said duct defining said air flow diversion chamber between said duct and said sleeve; and, a slotted annular flamelock plate member disposed within said perhiperal support means and fastened thereto in spaced relation therefrom to define a compacting flow passage therebetween and tangentially through said slots, said annular slotted flamelock plate member being positioned adjacent to said sleeve member outlet end in preselected position relative said spaced fuel outlet and igniter means to provide a first annular passage therearound, a second rotating passage therethrough and a third axial passage through the central opening thereof to enhance the burner flame wall and its location proximate the outlet end of said burner duct.

10. The fuel burner assembly of claim 1, said transverse baffle in said sleeve member having a plurality of spaced apertures therein;

a fuel supply tube and at least one igniter electrode passing snugly therethrough to be supported by said baffle and connected with said spaced fuel outlet and igniter means centrally positioned in said downstream chamber;

a peripheral support means fastened to the inner wall of said burner duct at the upstream end thereof to surround said fuel supply tube and said igniter electrode passing therethrough; and, adjusting means between said support means and said fuel tube to adjust the alignment thereof.

11. The fuel burner assembly of claim 1, and an air flow stabilizer including a plurality of spaced vanes mounted at the inlet end of said burner duct to stabilize the combustion air passing therethrough.

12. A fuel burner assembly for providing a stable, non-pulsating flame wall proximate the outlet of a burner duct comprising:

a longitudinally extending cylindrical burner duct having an upstream inlet end and a downstream outlet end, said inlet end being adapted to be connected to a source of combustion air and said outlet end being adapted to accommodate a burner flame wall proximate thereto;

a pair of spaced peripheral annular support firewall rings fastened to the inner wall of said burner duct at said upstream inlet end and said downstream outlet end of said duct;

a truncated cone disposed within said burner duct to extend along the longitudinal axis thereof, said truncated cone having inlet and outlet ends with said inlet end forming the base of said cone being fastened to the inner wall of said duct to communicate with said inlet end of said duct to receive combustion air therefrom and said smaller outlet end nesting with and in supported relation with said support ring at the outlet end of said burner duct to communicate with said outlet end of said duct, the outer wall of said truncated cone forming an air flow dampening diversion chamber of preselected volume with the inner wall of said burner duct, which chamber increases in cross-section from the upstream end toward the downstream end to vary the velocity and pressure of air flowing therealong, said truncated cone having a plurality of spaced apertures through the surrounding wall thereof extending from the upstream end of said cone to the downstream end of said cone to define an approximately twenty-nine (29) percent total open area through said side wall of said cone to form first air outlet passages and second air inlet passages in communication with said air diversion chamber;

a transverse baffle member extending across the inner wall of said truncated cone intermediate said inlet and outlet ends thereof to define an upstream chamber in communication with said first air outlet passages and a downstream chamber in communication with said second air inlet passages whereby a sufficient volume of combustion air to support continous combustion flows radially outward from said upstream chamber of said cone through said diversion chamber and radially inward into said downstream chamber of said cone, said transverse baffle in said cone having a plurality of spaced apertures therein;

a fuel supply tube and at least one igniter electrode passing snugly through said baffle apertures to be supported by said baffle, said fuel supply tube and igniter electrode terminating in said downstream chamber of said truncated cone in a spaced fuel outlet and igniter centrally positioned in said downstream chamber proximate the outlet end thereof to ignite with said inwardly directed combustion air to create a burner flame wall proximate the outlet end of said burner duct;

adjustable support means extending between said upstream inlet peripheral annular support ring and said fuel supply tube to adjust the supported alignment thereof;

an air flow stabilizer having a plurality of spaced air twirling vanes mounted within said burner duct adjacent to and downstream of said inlet peripheral support ring to stabilize combustion air passing therethrough; and, a slotted, disc-like, annular flamelock plate member mounted within said outlet peripheral support ring in spaced relation therefrom to define a first compacting annular flow passage therebetween, a second rotating flow passage tangentially through said slots, and a third axial flow passage through a central opening, said slotted flamelock plate member being positioned along the longitudinal axis of said burner duct adjacent to said truncated cone outlet end in preselected position relative said spaced fuel outlet and igniter to impart rotation to the ignited mixture passing therethrough and to enhance the burner flame wall and its location proximate said burner duct outlet end.

* * * * *